US005809158A

United States Patent [19]

van Halteren et al.

[11] Patent Number: 5,809,158

[45] Date of Patent: *Sep. 15, 1998

[54] TRANSDUCER

[75] Inventors: Aart Zeger van Halteren, Hobrede; Onno Geschiere, Amsterdam, both of Netherlands

[73] Assignee: Microtronic Nederland, B.V., Amsterdam, Netherlands

[ * ] Notice: The term of this patent shall not extend beyond the expiration date of Pat. No. 5,757,947.

[21] Appl. No.: 685,861

[22] Filed: Jul. 24, 1996

[30] Foreign Application Priority Data

Jul. 24, 1995 [NL] Netherlands ..... 1000878

[51] Int. Cl.[6] ..... H04R 25/00

[52] U.S. Cl. ..... 381/200; 381/69

[58] Field of Search ..... 381/200, 199, 381/194, 68, 69, 192; 29/594, 609.2

[56] References Cited

U.S. PATENT DOCUMENTS 3,111,563 11/1963 Carlson ..... 381/200
3,588,383 6/1971 Carlson .
3,617,653 11/1971 Tibbetts .
3,935,398 1/1976 Carlson et al. .
4,272,654 6/1981 Carlson .
4,410,769 10/1983 Tibbetts .

OTHER PUBLICATIONS

PCT/GB93/02140—International Filing Date: 15 Oct. 1993; International Publication No. WO 94/10817; Inventors/Applicants (for US only): Salvage, R.J., Harrington, S.J.

*Primary Examiner*—Huyen D. Le
*Attorney, Agent, or Firm*—Birch, Stewart, Kolasch & Birch, LLP

[57] ABSTRACT

A transducer, in particular suitable for hearing aids, comprising a coil, two spaced magnet elements, a membrane, and a U-shaped armature, a first leg of the U-shaped armature extending through the coil and the two magnet elements and being coupled with the membrane by means of a connecting element, limiting means being provided for limiting the maximum deflection of the first leg of the armature, which limiting means are disposed on the connecting element.

16 Claims, 3 Drawing Sheets

TRANSDUCER

This invention relates to a transducer, in particular suitable for hearing aids, comprising a coil, two spaced magnet elements, a membrane, and a U-shaped armature, a first leg of the U-shaped armature extending through the coil and the two magnet elements and being coupled with the membrane by means of a connecting element, and limiting means being provided for limiting the maximum deflection of the first leg of the armature.

BACKGROUND OF THE INVENTION

The above-described transducer is known, e.g., from U.S. Pat. No. 4,272,654. This publication describes a transducer in which limiting means are disposed on the inner part of the coil in the form of projections, in order to limit the maximally possible deflection of the first leg, thus increasing the shock resistance of the transducer.

This known transducer, however, has the drawback that providing the above limiting means is laborious and expensive.

It is the object of the invention to provide a solution to the above problem. To this end, the invention provides a transducer of the above type, characterized in that the limiting means are disposed on the connecting element.

By taking the steps of the invention, a transducer is provided which can be produced in an easy and inexpensive manner.

SUMMARY OF THE INVENTION

According to a first aspect of the invention, the connecting element comprises a connecting piece affixed to the first leg of the armature. The connecting piece may be C- or O-shaped, in such a manner that the connecting piece is slidable over the first leg of the armature and can thus be easily coupled therewith. The limiting means comprise wall portions disposed on both sides of the connecting piece, which provides the advantage that in case of a strong impact or shock the force is absorbed substantially by the wall portions and is transmitted to the first leg of the armature only via the connecting piece. Moreover, the connecting piece may be substantially I-shaped, the width of the connecting piece corresponding substantially to the thickness of the first leg of the armature, and the I-shaped connecting piece engaging the end of the first leg. Here the limiting means comprise wall portions disposed on the upper and lower sides of the connecting piece, the degree of limitation being determined by the thickness of the material of these wall portions. A transducer that can be produced very easily with one of the above embodiments of the connecting pieces is obtained if the connecting element is formed integral and is, e.g., an etching product.

According to a second aspect of the invention, the invention provides a transducer of the above type, characterized in that the limiting means are provided on at least one of the side faces of the magnets or the coil perpendicular to the first leg of the U-shaped armature. Here the limiting means can be disposed very easily, either on the side face of the coil facing away from the magnet elements or on the side face of the magnet elements facing away from the coil. The limiting means preferably comprise a U-shaped element of which the legs on the sides facing each other taper towards each other in the direction of the base of the U-shaped element. This type of limitation has the advantage that the U-shaped element can be mounted in the right position after magnetization of the transducer and adjustment of the first leg of the U-shaped armature relative to the magnet elements and the coil. Because of variations in the production of the coil and/or the magnet elements there is in fact a great risk that the spaces on both sides of the armature and the limiting means are unequal, with the result that the shock resistance in one direction will be inferior to that in the other direction. With the last-mentioned embodiment this problem is solved in an elegant manner. In a further embodiment the legs of the U-shaped element are provided on the sides facing each other with aligned projections, in order to reduce the risk that a side edge of the first leg of the armature, when in a slightly inclined position, strikes the sides facing each other.

According to a third aspect of the invention, the invention provides a transducer of the above type, characterized in that the distance of the two magnet elements relative to each other is reduced.

It is observed that a transducer is known from patent application WO 94/10817 in which the limiting means cooperate with the, seen in the longitudinal direction, central portion of the middle leg of an E-shaped armature, in order to limit the maximally possible deflection of the middle leg, thus increasing the shock resistance of the transducer. Here the limiting means may comprise elevated and lowered portions of the middle leg, individual elements disposed on the middle leg or individual elements reducing the space between the two magnets and/or of the coil near the central portion of the middle leg. Moreover, mention is made of the possibility of reducing the interspace of the two magnet elements or the coil.

This known transducer, however, has the drawback that providing the above limiting means is laborious and is expensive in case no standard parts can be used. A further drawback of the known transducer is that the symmetry of the limiting means relative to the armature is hard to realize because the limiting means can only be disposed before magnetization/adjustment.

BRIEF DESCRIPTION OF THE DRAWINGS

The invention will be explained below in more detail by means of a number of exemplary embodiments with reference to the accompanying drawings, in which.

DETAILED DESCRIPTION OF THE INVENTION

Figure 1:
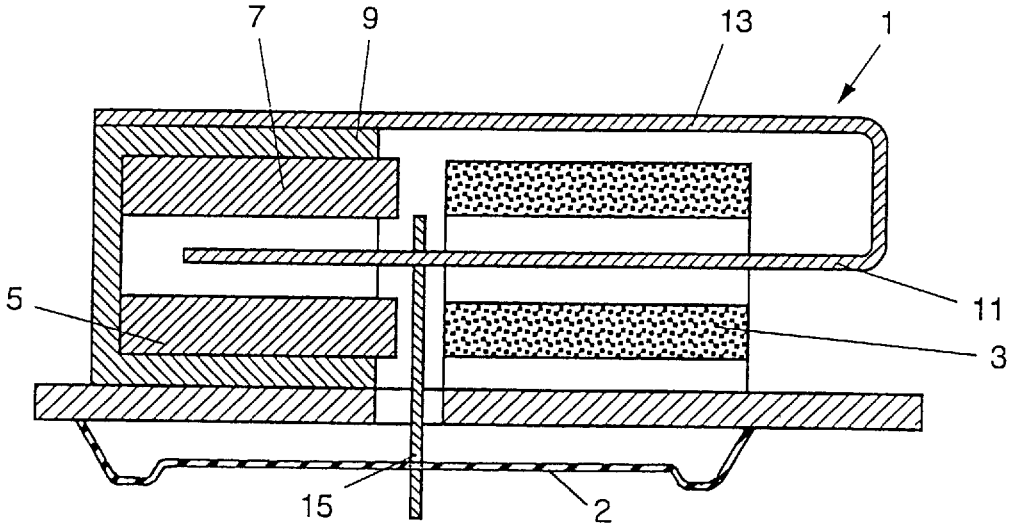
FIG. 1 is a cross-sectional view of a transducer having a U-shaped armature.

In the Figures, similar parts are indicated by the same reference numerals. FIG. 1 shows a transducer 1 known per se. This transducer comprises a coil 3 and two spaced magnet elements 5, 7, which may also be formed by an annular magnet. The magnet elements 5, 7 are placed in a magnet casing 9 sealing the two magnet elements on the side facing away from the coil 3. A first leg 11 of a U-shaped armature 13 extends through the coil 3 and the two magnet elements 5, 7. The central part of the first leg 11 of the U-shaped armature 13 is connected with a membrane 2 by means of a connecting element 15. The transducer, however, may also comprise an open magnet casing in which the connecting element 15 engages with the end of the first leg 11. The transducer operates as follows: The output signal of an amplifier, not shown, is transmitted to the coil 3, thus vibrating the first leg 11 of the armature 13 in cooperation with the permanent magnet field of the magnet elements 5, 7. The vibrating movements of the first leg 11 of the armature 13 are then transmitted via the connecting element 15 to the membrane.

Figure 2:
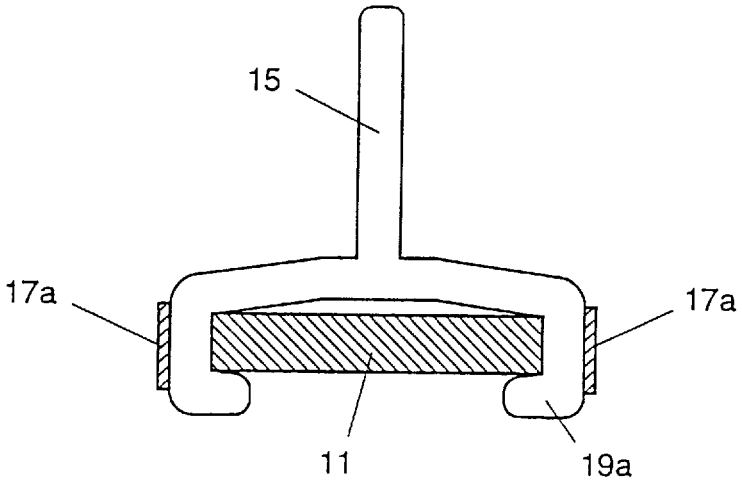
FIG. 2 is a cross-sectional side elevational view of a connecting element for a first embodiment of a transducer according to the invention.

FIG. 2 is a side elevational view of a first embodiment of the connecting element 15 for the transducer 1 shown in FIG. 1, having limiting means for limiting the maximum deflection of the first leg 11 of the U-shaped armature 13, thus increasing the shock resistance of the transducer 1. To this end, the connecting element 15 (which is connected to membrane 2) has a connecting piece 19*a* which is substantially C-shaped and has, on both sides thereof, substantially rectangular wall portions 17*a* forming the limiting means. The rectangular wall portions 17*a* have a height exceeding the thickness of the first leg 11 of the U-shaped armature 13. The C-shaped connecting piece can be slid on the end of the first leg 11 or on the central part of the first leg 11, in such a manner that the rectangular wall portions 17*a* are at least partially located in the space between the two magnet elements 5, 7 or in the interspace of the coil 3, so that an excessive deflection of the first leg 11 or the armature 13 beyond the bending limit thereof can be prevented.

Figure 3:
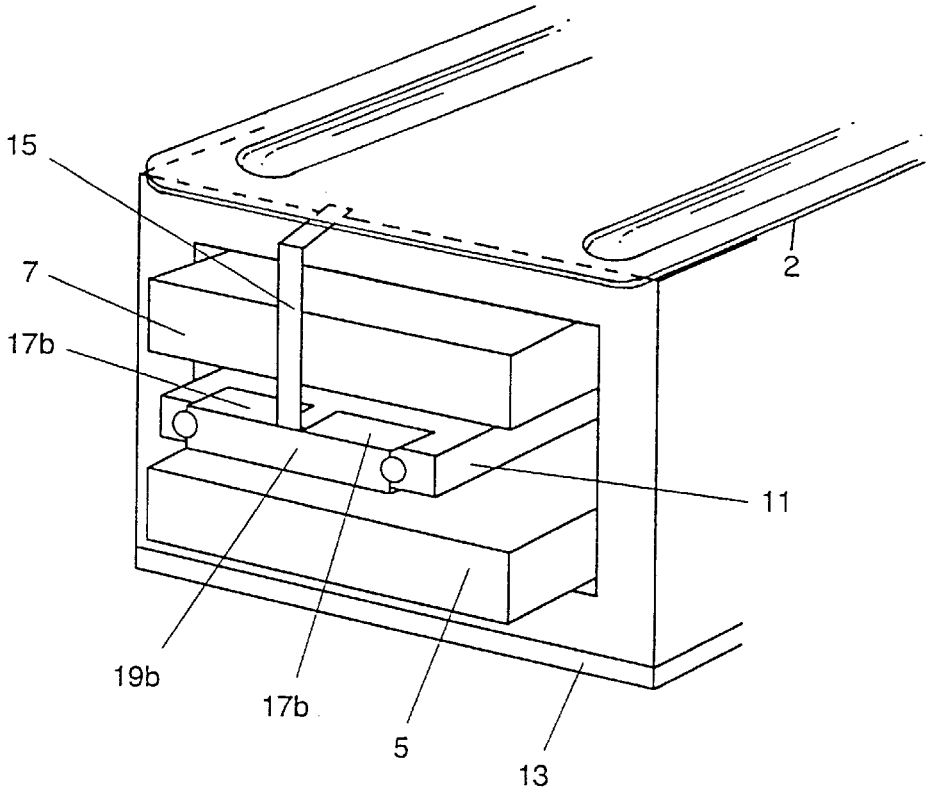
FIG. 3 is a perspective side elevational view of a connecting element for a second embodiment of a transducer according to the invention.

FIG. 3 is a perspective side elevational view of a second embodiment of the connecting element for the transducer 1 shown in FIG. 1, with limiting means. The connecting piece 19*b* is substantially I-shaped and is welded or glued to the end of the first leg 11 of the U-shaped armature 13, the width of the I-shaped connecting piece 19*b* corresponding substantially to the thickness of the first leg 11. The limiting means comprise substantially rectangular wall portions 17*b* provided on the upper and lower sides of the I-shaped connecting piece 19*b*. The thickness of these wall portions determines the maximally possible deflection of the first leg 11. A very simple embodiment of the transducer shown in FIG. 2 or 3 is obtained if the connecting element 15 is formed integral with the connecting piece 19*a* or 19*b* and the limiting means 17*b* and is, e.g., an etching product.

Figure 4:
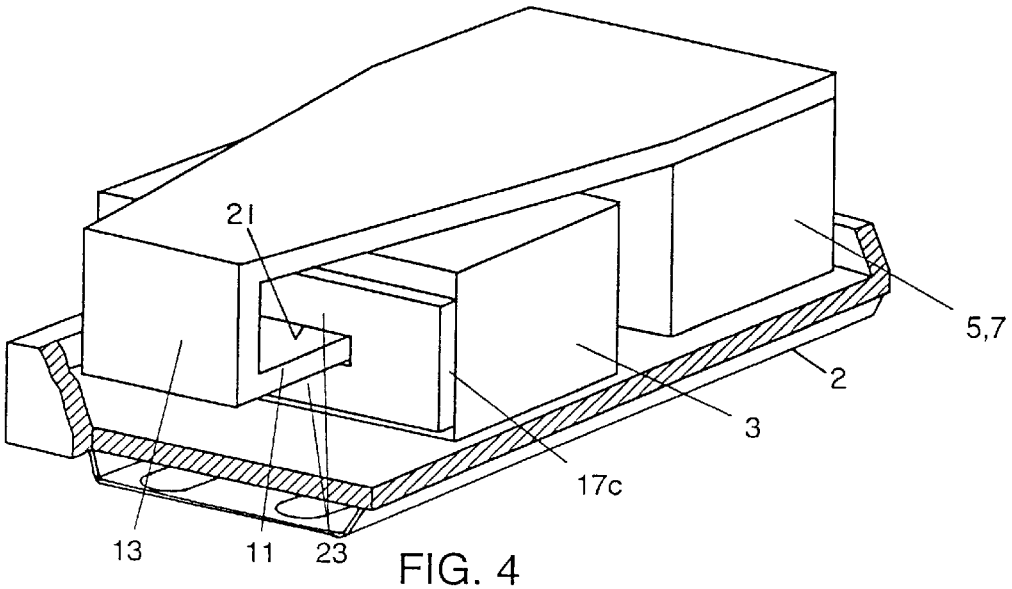
FIG. 4 is a schematic perspective side elevational view of a third embodiment of a transducer according to the invention.

FIG. 4 shows another variant in which the limiting means comprise a U-shaped element 17*c* disposed on the side face of the coil 3 facing away from the magnet elements 5, 7, in such a manner that the first leg 11 is positioned between the sides of the legs 23 of the U-shaped element 17*c* facing each other, so that the maximum deflection of the first leg 11 can be limited by these sides of the legs 23. To center the U-shaped element 17*c* with respect to the first leg 11, it is very advantageous if the sides of the legs of the U-shaped element 17*c* facing each other taper towards each other in the direction of the base thereof. The U-shaped element 17*c* is placed and fastened, e.g. with a hardening glue, on the side face of the magnet elements 5, 7 facing away from the coil 3, after magnetization of the transducer 1 and adjustment of the first leg 11. However, the transducer 1 may also be enclosed in a mould. Subsequently, a constant force is exerted on the armature 13, with the result that the armature 13 will slightly bend and thus a certain displacement of the first leg 11 relative to the coil 3 will take place. In this situation the U-shaped element 17*c* is placed on the coil 3 and glued thereto, the first leg 11 serving as a stop for the U-shaped element 17*c*. Subsequently, the force exerted on the armature 13 is removed, after which the first leg 11 will spring back to the starting position. Thus two equal spaces are formed between the first leg 11 and the U-shaped element 17*c* to obtain a symmetric shock resistance.

Figure 5:
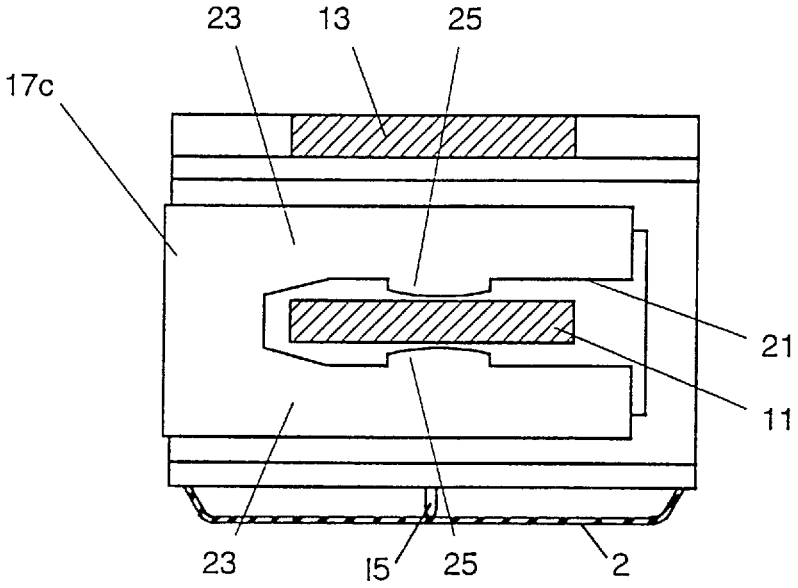
FIG. 5 is a schematic front elevational view of a special embodiment of a the U-shaped element shown in FIG. 4, having the armature accommodated therein.

FIG. 5 is a front elevational view of a special embodiment of the U-shaped element 17*c* shown in FIG. 4, with the first leg 11 of a U-shaped armature 13 accommodated therein. The legs 23 of the U-shaped element 17*c* have, on the sides facing each other, aligned projections 25. These projections 25 reduce the risk that the first leg 11 of the armature 13, when in a slightly inclined position, strikes the sides 21 facing each other and also limit the maximum deflection of the first leg 11.

It is self-evident that many modifications and variants are possible within the scope of the invention. Thus, e.g., the space formed by the magnet elements or the coil may also be reduced, in such a manner that the limiting means are then formed by the side wall portions facing inwards. Moreover, the limiting means 17*a* shown in FIG. 2 may comprise only one wall portion.

We claim:

1. A transducer, in particular suitable for hearing aids, comprising a coil, two spaced magnet elements, a membrane, and a U-shaped armature, a first leg of the U-shaped armature extending through a space within the coil and a space between the two magnet elements and being coupled with the membrane by means of a connecting element, and limiting means being provided for limiting the maximum deflection of the first leg of the U-shaped armature, wherein the limiting means is directly connected to the connecting element and at least partially is disposed in said space within the coil or within said space between the two magnet elements.

2. A transducer according to claim 1, wherein the connecting element comprises a connecting piece affixed to the first leg of the U-shaped armature.

3. A transducer according to claim 2, wherein the connecting piece is substantially C- or O-shaped, in such a manner that the connecting piece encloses the first leg of the U-shaped armature.

4. A transducer according to claim 2, wherein the limiting means comprise wall portions disposed on both sides of the connecting piece.

5. A transducer according to claim 2, wherein the connecting piece is substantially I-shaped and engages with the end of the first leg of the U-shaped armature, in such a manner that the thickness of the connecting piece corresponds substantially to the thickness of the first leg of the armature.

6. A transducer according to claim 2, wherein the limiting means comprise wall portions disposed on the upper and lower sides of the connecting piece.

7. A transducer according to claim 2, wherein the connecting element is formed integral with the connecting piece and the limiting means.

8. A transducer according to claim 7, wherein the connecting element with the connecting piece and the limiting means is an etching product.

9. A transducer, in particular suitable for hearing aids, comprising a coil, two spaced magnets, a membrane, and a U-shaped armature, a first leg of the U-shaped armature extending through the coil and the two magnets and being coupled with the membrane by means of a connecting element, and limiting means being provided for limiting the maximum deflection of the first leg of the armature, wherein the limiting means is affixed onto at least one of the side faces of the magnets or the coil, said at least one of the side faces being perpendicular to the first leg of the U-shaped armature.

10. A transducer according to claim 9, wherein the limiting means are disposed either on the side face of the coil facing away from the magnet elements or on the side face of the magnet elements facing away from the coil.

11. The transducer according to claim 10, wherein the limiting means comprise a U-shaped element.

12. The transducer according to claim 11, wherein the legs of the U-shaped element on the sides facing each other taper towards each other in the direction of the base of the U-shaped base.

13. The transducer according to claim 12, wherein the legs of the U-shaped element are provided on the sides facing each other with aligned projections.

14. A transducer according to claim 9, wherein the limiting means comprise a U-shaped element.

15. A transducer according to claim 14, wherein the legs of the U-shaped element on the sides facing each other taper towards each other in the direction of the base of the U-shaped element.

16. A transducer according to claim 14, wherein the legs of the U-shaped element are provided on the sides facing each other with aligned projections.

* * * * *